United States Patent [19]

Upton

[11] 4,038,747

[45] Aug. 2, 1977

[54] ELECTRIC RAZOR HAVING AN OSCILLATING CUTTING HEAD

[76] Inventor: Douglas J. Upton, 18740 Devonshire, Northridge, Calif. 91324

[21] Appl. No.: 633,471

[22] Filed: Nov. 19, 1975

Related U.S. Application Data

[62] Division of Ser. No. 401,163, Sept. 27, 1973, Pat. No. 3,921,270.

[51] Int. Cl.[2] ..... B26B 19/26; B26B 19/42

[52] U.S. Cl. ..... 30/34.2; 30/43.3; 30/43.5; 30/43.7

[58] Field of Search ..... 30/34.2, 43.3, 43.5, 30/43.7, 43.8, 43.9

[56] References Cited

U.S. PATENT DOCUMENTS

| | | | |
|---|---|---|---|
| 2,220,911 | 11/1940 | Khalil | 30/43.8 X |
| 2,749,613 | 6/1956 | Miller | 30/34.2 |
| 2,916,819 | 12/1959 | Miller | 30/34.2 |
| 2,952,907 | 9/1960 | Miller | 30/34.2 |
| 3,142,118 | 7/1964 | Marescalchi | 30/43.5 |
| 3,264,734 | 8/1966 | Starre | 30/43.5 |

FOREIGN PATENT DOCUMENTS

| | | | |
|---|---|---|---|
| 213,581 | 3/1958 | Australia | 30/34.2 |
| 1,428,943 | 1/1966 | France | 30/43.5 |
| 634,266 | 2/1962 | Italy | 30/43.5 |

*Primary Examiner*—Al Lawrence Smith
*Assistant Examiner*—K. J. Ramsey
*Attorney, Agent, or Firm*—Roger A. Marrs

[57] ABSTRACT

An electric razor is disclosed herein having a case housing an electric motor and a gear driving train operably coupled to a moving cutting head. The head includes at least one cutting blade driven by the motor either in a back and forth stroking manner or in a rotary motion. The cutting head is movably carried on the case by an oscillating plate driven by the gear train so that the entire cutting head including the cutting blade or blades moves while the cutting blade or blades are driven in their stroking or rotary movement. Tension rollers are provided about the periphery of the oscillating plate engageable with the skin of the user for stretching the skin to expose more of the hair shaft preparatory for cutting.

4 Claims, 11 Drawing Figures

Fig. 1
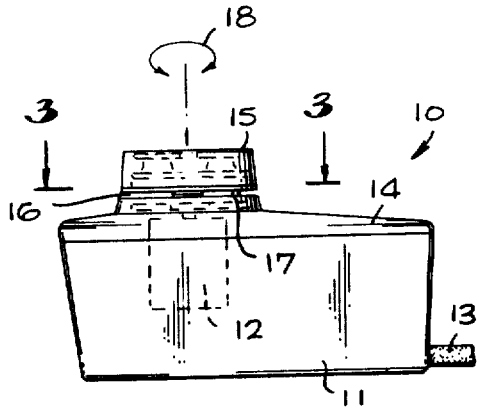
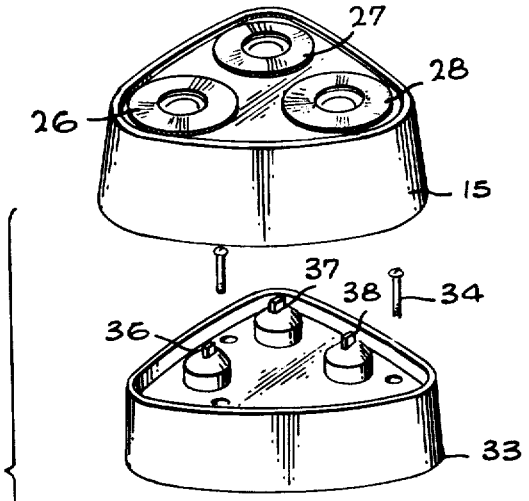
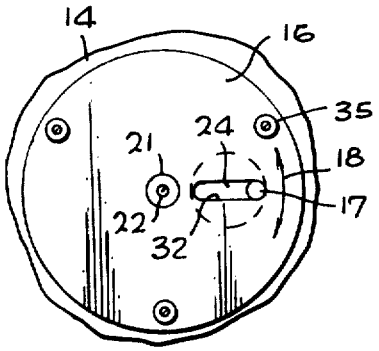
Fig. 3
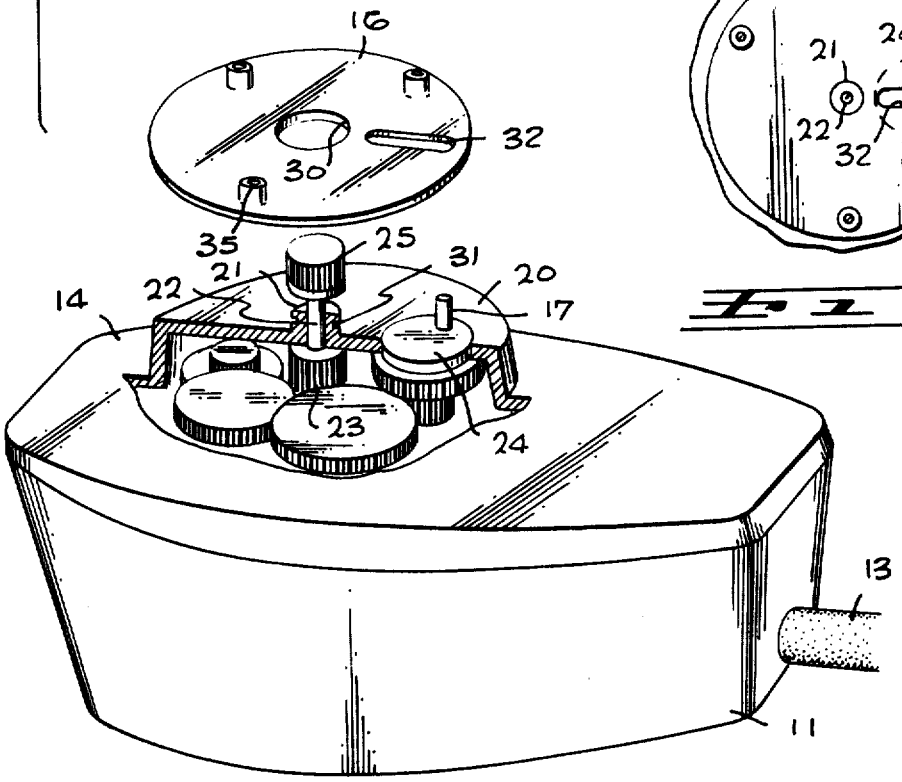
Fig. 2

Fig. 4
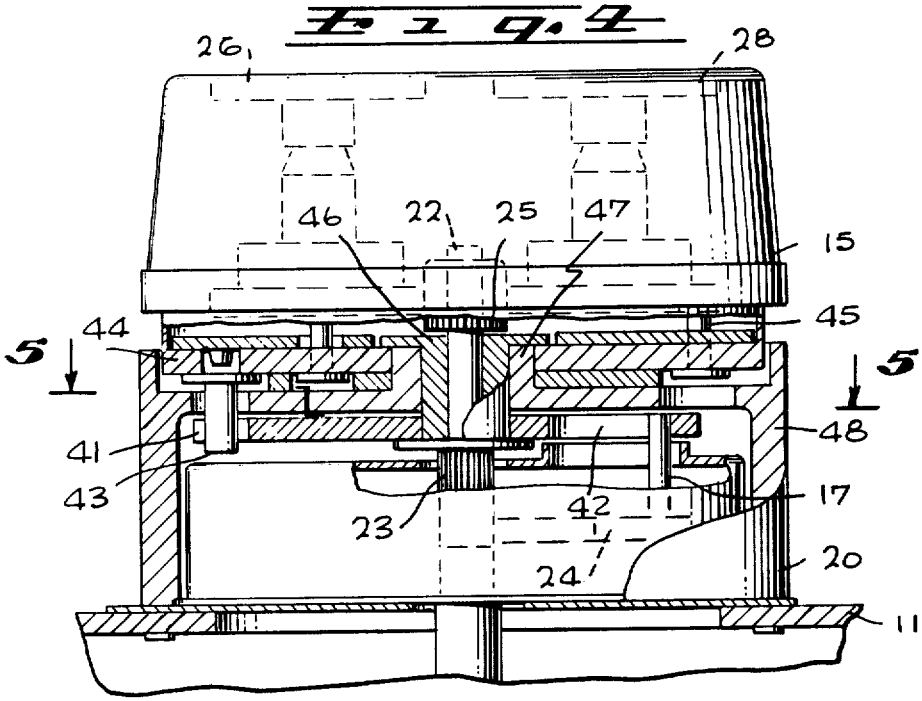
Fig. 6
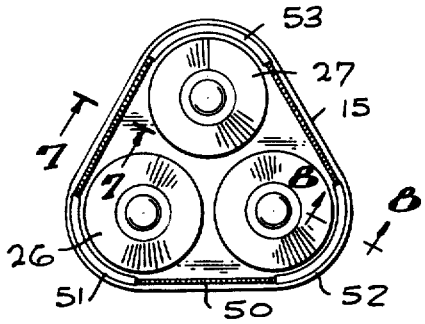
Fig. 5
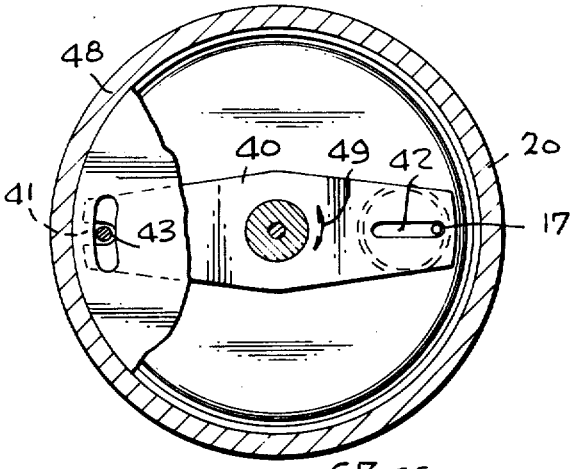
Fig. 7
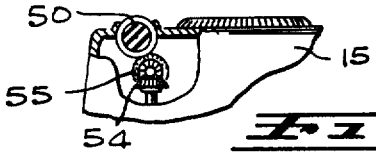
Fig. 8
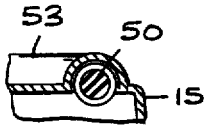
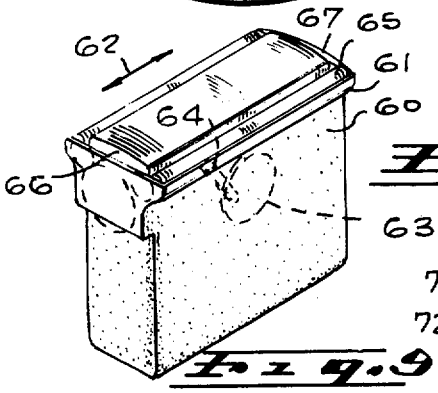
Fig. 9
Fig. 10
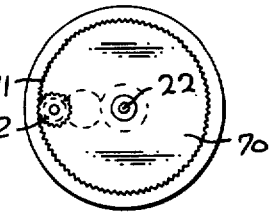
Fig. 11
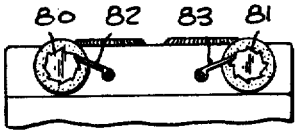

ELECTRIC RAZOR HAVING AN OSCILLATING CUTTING HEAD

This is a division of application Ser. No. 401,163, filed Sept. 27, 1973 now U.S. Pat No 3,921,270.

BACKGROUND OF THE INVENTION

1. Field of the Invention

This invention relates to the field of shaving apparatus and more particularly to a novel shaver having means for imparting a circular, a reciprocating semicircular or oscillating movement to the cutting head thereof.

2. Brief Description of the Prior Art

In the past, shaving hair from the skin such as a facial beard was achieved by means of a safety razor having a finely honed cutting edge formed along one side of a steel blade. However, as the cutting edge is drawn over the skin, nicks, cuts and actual removal of an epidermal layer is experienced which promotes infection, ingrown hairs and other skin disorders. This procedure is time consuming and requires shaving cream or other lathering substances for softening the bristles.

To avoid some of the aforementioned problems, it is the conventional practice to employ methods of dry shaving using automatic razors. In general, such a razor includes a case or housing which encloses a motor means having a drive shaft operably connected to a cutting means carried on a fixed cutting head. The cutting means generally include blades which are operated in a circular manner or in a pivoted linear movement depending on the style and construction of the shaver. The shaving procedure generally requires that the shaving head with the cutting blades be kept flat against the face, and maintained with a firm and even pressure thereagainst. The skin is kept taut by stretching the skin ahead of the cutting head by employing the user's fingers. This skin stretching procedure promotes the whiskers or bristles to stand straight up to expose more bristle so that the moving cutting blade can severe them below normal skin level. It is also recommended procedure to shave against the grain direction of the whiskers using a back-and-forth or round-and-round circular motion. This motion is of course manual and requires wrist and finger manipulation by the user to achieve proper results.

Although conventional electric razors do cut and remove whiskers and hair, problems have been encountered which primarily reside in the fact that the hair shaft or whisker bristle is not cut close to the skin and a stub remains. Also, the skin stretching procedure and the shaver circular motion procedure are annual operations which are not always understood and practiced by the user. The end result is that a close shave cannot be readily achieved so that a hair stub remains. Furthermore, although conventional safety blade razors can provide a close cut, such razors generally nick or cut the users skin during the shaving procedure which is obviously undesirable.

Therefore, a need has long existed to provide a hand-held motorized razor or shaver having automatic means for stretching the skin as the cutting blades perform their cutting procedure and simultaneously oscillating the cutting head in a motion so that the user need not require any manual dexiterity.

SUMMARY OF THE INVENTION

Accordingly, the above problems and difficulties encountered with the conventional shaving apparatus are obviated by the present invention which provides a razor having a case mounting a motor means and a drive train operably connected to a cutting means assembly carried on a plate which is driven by the drive train and provides an overall circular, oscillating or reciprocal semi-circular motion to the cutting head or means assembly as the shaving proceeds. The cutting head or assembly is also provided with skin stretching means that in one form includes a continous steel coil rotatably carried about the perimeter of the cutting head so as to encircle the cutting blades, Portions of the steel coil are covered so that other portions are exposed for engagement with the skin. The exposed portions of the coil are rotated in opposite directions so that the skin is stretched therebetween exposing greater depth of cut for the cutting blade with respect to an upstanding bristle or hair shaft. Therefore, by providing an oscillating cutting head, an additional opportunities are gained by the user at cutting the hair bristle since the skin is held taut so as to exopse more of the bristle to the cutting edge.

Therefore, it is among the primary objects of the present invention to provide a novel shaving apparatus having means for providing an oscillatory motion to the cutting head.

Another object of the present invention is to provide a novel electric shaver having a rotating or oscillating cutting head capable of cutting a plurality of bristles closer to the skin than is otherwise obtainable using conventional shavers.

A further object resides in providing a skin stretching means adapted to stretch the user's skin in the cutting area so as to expose more of a hair shaft or bristle.

It is another object of the present invention to provide a novel shaving apparatus having a rotatable plate mounting the cutting means that is operable by a drive train to oscillate in a back-and-forth manner.

Still a further object in the present invention is to provide a novel shaving apparatus that will shave to a closer degree and dimension than can be otherwise gained by the use of conventional shaving apparatus.

Another object resides in the provision of a novel shaving apparatus that is easy to handle and saves time in the performance of the shaving procedure.

Another object resides in a novel shaving apparatus having means providing a facial massage for stimulating the epidermal layers during the shaving procedure.

BRIEF DESCRIPTION OF THE DRAWINGS

FIG. 1 is a side elevation view of the novel electric shaver or razor employed for shaving procedures in accordance with the present invention;

FIG. 2 is an enlarged exploded view of the electric shaving razor shown in FIG. 1;

FIG. 3 is a transverse cross-sectional view of the cutting head employed on the razor shown in FIG. 1 as taken in the direction of arrows 3—3 thereof;

FIG. 4 is an enlarged cross-sectional view of another embodiment of the present invention for rotating the cutting head in a circular movement;

FIG. 5 is a transverse cross-sectional view taken in the direction of arrows 5—5 of FIG. 4;

FIG. 6 is a top plan view of an oscillating cutting head employing skin stretching means incorporated into the present invention;

FIG. 7 is a sectional view taken in the direction of arrows 7—7 of FIG. 6;

FIG. 8 is a sectional view taken in the direction of arrows 8—8 in FIG. 6;

FIG. 9 is still another embodiment of the present invention illustrating means for moving the cutting head in a reciprocal manner;

FIG. 10 is a fragmentary view of another embodiment of the present invention that provides a circular motion to the cutting head assembly; and FIG. 11 is a sectional view of another skin stretching mechanism.

DESCRIPTION OF THE PREFERRED EMBODIMENT

Referring now to FIG. 1, the novel electric shaver of the present invention is illustrated in the general direction of arrow 10 which includes a housing 11 containing a drive motor indicated in dotted lines by numeral 12 and which is connected to a source of power via a cord 13. It is to be understood that the present invention may be operated either via a conventional power source such as an AC line, by battery or spring motor or the like.

The housing 11 further includes a base portion 14 on which is mounted a cutting head 15. It is to be particularly noted that the cutting head 15 forms an assembly including a plurality of rotary cutting blades which are operated by means of a gear train to be described later. The cutting head is carried on a plate 16 that is moved in a reciprocating or oscillating rotary motion in relation to base portion 14 by means of a pinion slot arrangement incorporating a driving pin 17.

The reciprocating or oscillating rotary or circular motion is indicated by the arrows associated with the numeral 18. This motion is the general motion of the entire assembly 15 and it is a motion independent of the continous rotation of the cutting blade. The motion of the assembly 15 is arcuate in a back-and-forth manner and all of the rotating cutting blades will move in this manner as they are independently rotated in their continous circular manner.

Referring now in detail to FIG. 2, it can be seen that the base 14 carried on the case or housing 11 includes a raised portion 20 having a central post 21 through which a drive shaft 22 projects. One end of the drive shaft 22 is fixedly connected to a pinion 23 that is driven by the motor 12. Via a plurality of gears comprising a gear train, rotary motion from the pinion gear 23 is transferred to a disc 24 which causes rotary movement of the drive pin 17. The drive train from pinion 23 to disc 24 includes a plurality of circular gears having intermeshed teeth. The disc 24 is mounted so as to be exposed through an opening in the raised portion 20 of the base 14 whereby the drive pin 17 extends outwardly from the raised portion. The drive shaft 22 includes a cutter driving pinion 23 that is operably connected and coupled in driving relationship to a plurality of rotary drive cutters. The cutters are indicated by numerals 26, 27 and 28 respectively. It is to be understood that the driving relationship is conventional and need not be shown in detail herein.

It is to be noted that plate 16 is coaxially disposed with respect to drive shaft 22 and includes a central opening 30 adapted to be placed about central post 21. The plate 16 is retained in this position by means of a snap ring carried within a circular groove 31 formed in post 21. An elongated slot 32 is formed in plate 16 through which driving shaft or pin 17 is projected. Therefore, as the disc 24 is rotated via the gear train and the pin 17 is rotated, the pin will move from one end of the slot 32 to its opposite end and cause the disc 16 to rotate thereby. The rotation will be reciprocal so that the disc 16 moves in a back-and-forth manner.

It is to be understood that the plate 16 mounts the cutter assembly which includes a cutter blade drive mechanism or assembly incased within housing 33 that is mounted to the plate 16 via a plurality of screws 34 engageable with threaded post 35 carried on the plate. The cutting drive assembly further includes a plurality of drive shafts associated so that each drive shaft carries a cutter. For example, drive shafts 36,37 and 38 are operably connected to drive cutters 26 - 28.

It is to be understood that the head assembly 15 covers the cutter driving assembly 33 and that both assemblies are carried on plate 16. In FIG. 3, it can be seen that as disc 24 rotates, drive pin 17 slides within slot 32 to wobble plate 16 in a reciprocating circular motion. This motion is indicated by the numeral 18 and is the same motion as indicated in FIG. 1. While the plate 16 is being driven in a reciprocal circular motion, the cutters 26 - 28 inclusive are driven in a continous rotating manner to effect hair cutting or shaving. All of the rotary cutters are subjected to the back-and-forth circular movement of plate 16 while they are independently being driven in their rotary motion by drive mechanism associated with shafts 36 - 38 inclusive.

Referring now in detail to FIGS. 4 and 5, another embodiment of the present invention is illustrated which is similar to that shown in FIGS. 1 - 3 inclusive. Like numerals correspond to similar components between the two embodiments. It is to be especially noted that plate 16 in the embodiment shown in FIGS. 1 - 3 is replaced by an elongated member 40 which includes a notch 41 at one end and an elongated slot 42 at its opposite end and that member 40 operates in cooperation with plate 44. Pin 17 is slidably disposed within slot 42 while a second pin 43 is downwardly depending into the notch 41 on the end of member 40. Pin 43 is carried on a support plate or member 44 to which the shaving head assembly 15 is secured by a plurality of fasteners, such as fastener 45. The plate 44 and the elongated member 42 are carried coaxially about a flanged bearing 46 supported on shaft 22. The bearing mounts these latter members onto a fixed housing central post 47 carried on the fixed housing 48. The fixed housing encloses the drive train and working gears so that it may collectively be referred to as the gear housing 20.

Therefore, it can be seen that the shaving cutter assembly including the cutters 26, 27 and 28 are carried on a wobble or oscillating plate 44 which is rotated in a reciprocal back-and-forth motion as indicated by arrow 49 in FIG. 5. The plate 44 is rotated in this manner by means of pin 43 projecting into end slot 41 of the member 40. Member 40 in turn, is initially rotated in the back-and-forth movement by means of pin 17 in slot 42.

Referring now to FIG. 6, the shaver of the present invention further includes a skin stretching means adapted to pull in opposite directions about the area being shaved by the cutters 27 - 28 inclusive. Such means may include a continous steel, flexible coil, belt or band 50 that is trained about the perimeter of the shaving assembly 15 so that the cutters 27 - 28 inclusive are within the confines or perimeter of the band. It is to be particularly noted that the coil or band is covered by curved portions of the housing indicated by numerals 51, 52 and 53 so that a linear length of the coil is exposed to engage the surface of the skin. The continous coil is driven, as seen in FIG. 7, by a suitable pinion 54 engageable with a friction drive gear 55 that engages with the coil 50. Therefore, it can be seen that the coil is rotating in opposing directions on opposite sides of the shaving head. In this manner, the skin is stretched therebetween sufficient enough to expose more of the hair shaft or bristle than can otherwise be exposed using conventional methods.

Referring now to FIG. 9, another enbodiment of the present invention is shown which comprises a rectangular case 60 which houses a motor conventionally coupled to a movable cutting blade or blades by means of a gear train. These components need not be shown since they are conventional and form no part of the present invention. However, it is noted that the case 60 mounts a shaving head 61 enclosing the cutting blades which moves in a reciprocal rectilinear motion as indicated by the double arrows 62. This motion or movement is in addition to the sweep action of the cutting blades. It is also to be understood that linear moving cutters can be employed as well as sweeping cutters. It is only important for the present invention to understand that the head 61 moves simultaneously with whatever cutting action is provided. The shaving head 61 moves in the direction of arrows 62 by means of a gear train 62 comprising a wheel 63 having an eccentric lever 64 connected at opposite ends between wheel 63 and 61. The lower portion of shaving head 61 is slidably mounted on the upper end of case 60.

A skin stretching arrangement is indicated in which a steel coil 65 is arranged in an oval path about the skin engaging surface of the shaver. The periphery of the coil 65 extends slightly above the cutting head so as to engage with the skin on opposite sides of the skin area being shaved. Inasmuch as the coil is rotated, the side segments of the coil on opposite sides of the cutting head will rotate in opposite directions. For example, one side segment of the coil will rotate in a clockwise direction while the other side of the coil will rotate in a counter-clockwise direction. It is to be particularly noted that the opposite ends of the coil are enclosed within a rounded portion indicated by the numerals 66 and 67 so that no portion of the coil thereunder will engage with the user's skin. This arrangement is similar to that shown in FIG. 8.

Another skin stretching mechanism or means is shown in FIG. 11 which includes at least two skin friction rollers 80 and 81 which are rotatably mounted on the cutting head assembly so as to move therewith in the aforementioned movements. However, rotary movement is clockwise on one roller while counter clockwise on the other roller due to a separate ratchet mechanism associated with each roller and indicated by numerals 82 and 83. Each mechanism includes a gear carried on the roller and a tooth operable therewith. The user's skin will be stretched between the two rollers which causes more exposure of hair bristles or shafts. The rachet mechanism may also take the form of a uni-directon clutch or bearing.

In FIG. 10, a circular movement is provided for the cutting head assembly which includes a ring gear 71 formed about the periphery of plate 70 which is driven by a pinion gear 72. Pinion gear 72 is operably driven by shaft 22 and the rotating cutters 26, 27 and 28 are carried on plate 70 so that the assembly moves in a circular path.

In view of the foregoing, it can be seen that the novel shaving apparatus of the present invention provides a circular, reciprocal semi-circular movement or oscillating movement for the cutting head of a razor while the cutter of the razor simultaneously move in their cutting manner. It matters not whether the cutters take the form of a rotary cutter, a sweep cutter or a rectilinear stroke, the shaving head will move in its oscillating motion. Such simultaneous movement provides an improved shave which is relatively close to the skin and elemenates beard stubbles and does not require as frequent a shave as currently required using conventional shaving instruments. By the skin stretching means, more of the hair shaft or bristle is exposed to the cutting edge of the blade for severing. After the shaving procedure has been concluded, the skin has not been penetrated and there has been no removal of any epidermal layers.

While particular embodiments of the present invention have been shown and described, it will be obvious to those skilled in the art that changes and modifications may be made without departing from this invention in its broader aspects and, therefore, the air in the appended claims is to cover all such changes and modifications as fall within the true spirit and scope of this invention.

What is claimed is:

1. In a shaving apparatus including a housing for enclosing a motor means, a cutting means assembly adapted to engage and cut hair bristles or shafts and gear means operably interconnecting said motor means to said cutting means, the improvement which comprises:

means movably supporting said cutting assembly means on said housing so that said cutting means assembly moves as a unit in a predetermined path with respect to said housing;

means operably mounted on said cutting means for engaging with the skin of the user to stretch the skin in the area of the bristles being cut;

said skin stretching means comprises:

an endless rotatable coil encircling said cutting means and operably carried on said cutting means assembly so that portions of said coil rotate in opposite directions separated by said cutting means.

2. The invention as defined in claim 1 wherein:

said coupling means includes an elongated member having slot provided near one end and a notch provided at the other end;

said plate having a downwardly depending pin disposed in said notch and said gear means having a pin upwardly projecting into said slot;

said member mounted at its center for rotation in response to movement of said upwardly projecting pin whereby said plate oscillates in an arcuate path via said downwardly projecting pin.

3. The invention as defined in claim 1 including covering means mounted on said assembly for covering other portions of said coil so as to provide separation of said coil from the skin of the user; and a drive train operably coupling said motor means to said coil.

4. The invention as defined in claim 1 wherein said predetermined path is circular.

* * * * *